US006619202B2

(12) United States Patent
Aida

(10) Patent No.: US 6,619,202 B2
(45) Date of Patent: Sep. 16, 2003

(54) PRINTING MACHINE WITH PLURAL PRINTING SECTIONS AND PRINTING METHOD

(75) Inventor: Yuki Aida, Ibaraki-ken (JP)

(73) Assignee: Riso Kagaku Corporation, Tokyo (JP)

( * ) Notice: Subject to any disclaimer, the term of this patent is extended or adjusted under 35 U.S.C. 154(b) by 0 days.

(21) Appl. No.: 10/092,519

(22) Filed: Mar. 8, 2002

(65) Prior Publication Data

US 2002/0124748 A1 Sep. 12, 2002

(30) Foreign Application Priority Data

Mar. 9, 2001 (JP) ..... 2001-067387

(51) Int. Cl.[7] ..... B41F 13/24; B41J 2/01

(52) U.S. Cl. ..... 101/232; 358/1.13; 347/104

(58) Field of Search ..... 101/232, 216, 101/212, 11, 37, 40, 40.1, 43, 44, 53, 118, 224, 225, 227, 228, 231, 233, 237, 238, 272, 276, 278; 271/3.14, 8.1, 9.01; 400/578, 580, 582, 583.2, 583.3, 584; 358/1.13, 1.4; 347/104, 116, 193

(56) References Cited

U.S. PATENT DOCUMENTS 5,285,723 A * 2/1994 Ichikawa et al. ..... 101/35
5,606,913 A * 3/1997 Kowalewski ..... 101/183
5,813,333 A * 9/1998 Ohno ..... 101/181
6,141,028 A * 10/2000 Aruga ..... 347/193
6,178,883 B1 * 1/2001 Satoh et al. ..... 101/220
6,421,133 B2 * 7/2002 Kasai et al. ..... 358/1.13

OTHER PUBLICATIONS

Seiko Epson Corp. Inkjet printer estimates viscosity adjustment value of ink, based on measured quantity of ink to be discharged, for adjusting ink viscosity. Pub–No: JP 2000309111A; Pub–Date: Nov. 7, 2000; pp. 007.*

* cited by examiner

*Primary Examiner*—Andrew H. Hirshfeld
*Assistant Examiner*—Hoai-An D. Nguyen
(74) *Attorney, Agent, or Firm*—Nath & Associates PLLC; Gary M. Nath; Marvin C. Berkowitz

(57) ABSTRACT

A method and machine for printing is disclosed as having a housing, a plurality of printing sections mounted in the housing configured to execute printing operation on the basis of given data, a control section configured to control so that the respective printing sections print on the print sheets on the basis of print data while identification marks are printed on the print sheets on the basis of identification mark data representing which printing section has been operated to execute printing, and a sheet discharge section on which the print sheets, printed at and outputted from the respective printing sections, are placed in a stack.

10 Claims, 7 Drawing Sheets

1 , 2
TEST PATTERN
IDENTIFICATION MARK
10 , 50
4
1
PRINTING SECTION 1
20a,60a
4
2
PRINTING SECTION 2
20b,60b
4
5
PRINTING SECTION 5
20e,60e
6
IDENTIFICATION MARK DATA
7
PRINT CARTRIDGE ADJUSTMENT DATA
30,70
CONTROL SECTION
INPUT IDENTIFICATION MARK DATA AND PRINT CARTRIDGE ADJUSTMENT DATA

PRINTING MACHINE WITH PLURAL PRINTING SECTIONS AND PRINTING METHOD

This application claims benefit of priority under 35 USC §119 to Japanese Patent Application No. P2001-067387, filed on Mar. 9, 2001, the entire contents of which are incorporated herein by reference.

BACKGROUND OF THE INVENTION

1. Field of the Invention

The present invention relates to printing machines having a plurality of printing sections and printing methods. More particularly, the invention relates to a printing machine and a printing method being easy to discriminate a specific printing section, which has executed the printing of a particular print sheet.

2. Description of the Related Art

In the related art, extensive attempts have heretofore been undertaken to provide printing machines, such as ink jet printers, thermal head printers and stencil printing machines, which allow a print sheet to be reproduced with notes and image data prepared by personal computer. These printing machines are devised in various ways so as to maintain a reproduced image at a high quality.

For example, in a serial printer arranged to perform bi-lateral printing by shifting a print head in the main scanning direction, the presence of bi-lateral printing operations carried out over a long time causes a shear in the printing position with respect to a main scanning direction, due to a backlash of the drive mechanism of a print head occurring in the main scanning direction or an imbalance occurring in a drive mechanism owing to stretching of a carriage belt.

Generally such a shear in the printing position is corrected by adjusting the alignment of the print cartridge.

When adjusting the alignment of the print cartridge, as shown in FIG. 1, a plurality of (for example, thirty) vertical rule marks, as indicated by a set of lines "a", are initially printed on a print sheet at an equal interval by shifting a print head from left to right in the main scanning direction.

Then, a plurality of vertical rule marks, as indicated by a set of lines "b", are printed on the print sheet by shifting the print head from right to left in the main scanning direction, so that the amounts of displacement of the vertical rule marks "b" with respect to the previously printed vertical rule marks "a" gradually change (i.e. increase or decrease) at a predetermined rate.

Finally, the vertical rule marks, as indicated by a set of lines "c", are printed in the same manner as the vertical rule marks "a".

These printed matters as shown in FIG. 1 are referred to as test patterns, which have reproduced the print cartridge adjustment data (that corresponds to alignment adjustment data for the print head).

Among these test patterns, the number of the test pattern, wherein particular the vertical rule marks along a vertical line are closest to a straight line is selected and is stored in particular section of the serial printer as an adjustment value to a control section via an operation panel mounted on a body of the serial printer or a printer driver installed in the computer connected to a serial printer. Then, based on the adjustment value the shear in the printing position is corrected by controlling the print head.

For example, since number "16" of the test patterns wherein the shear of the respective vertical rule marks in printing among the sets of lines a, b, c remains at a minimum value as shown in FIG. 1, number "16" as a adjustment value is inputted to a control section via an operation panel mounted on a body of the printing machine or a printer driver installed in the computer, and stored in a predetermined section of the serial printer. Then, based on the adjustment value the shear in the printing position is corrected by controlling the print head In addition, print cartridge adjustment data may also involve data for executing the cleaning of an election nozzles.

SUMMARY OF THE INVENTION

During such an adjustment process of the print cartridge, in a case where the test patterns are outputted from a printing machine equipped with one set of a printing section, it is easily to judge which printer outputted the test patterns.

However, with a printing machine equipped with a plurality of printing sections, once the test patterns have been printed on the print sheets it becomes difficult to judge the correspondence between the printing section which printed the test patterns and its test patterns.

Further, there are some instances where the use of plural printing sections to execute printing operations on a large number of print sheets causes print sheets of a deteriorated print quality to be produced. In such instances, it is not easy to judge which printing section has outputted the print sheets of a deteriorated print quality.

The present invention has been made with the above in mind and has an object of providing technology wherein identification marks corresponding to respective printing sections are printed on print sheets when printed by the respective printing sections, respectively, thereby providing ease of judgment of the corresponding relationship between the printing sections and the print sheets correlated therewith.

To achieve the above object, an aspect of the present invention inheres in a printing machine encompassing a housing; a plurality of printing sections mounted in the housing configured to execute a printing operation on the basis of given data; a control section configured to allow the respective printing sections to print on print sheets on the basis of print data while controlling the respective printing sections to allow print identification marks to be printed on the print sheets on the basis of identification mark data representing the printing section; and a sheet discharge section configured to allow printed sheets outputted in respective printing sections to be stacked.

Another aspect of the present invention inheres in a method of printing embracing the steps of printing on print sheets at a plurality of printing sections on the basis of print data; printing identification marks on the print sheets on the basis of identification mark data representing which printing section has been operated to execute printing; and placing the print sheets, which has been printed and outputted at the respective printing sections, in a stack in a sheet discharge section.

Still another aspect of the present invention inheres in a method of printing embracing the steps of inputting print data and identification mark data representing which printing section has been operated to execute printing into a printing machine; allocating the print data and the identification mark data to corresponding printing sections, respectively; printing on print sheets, transferred to a plurality of printing sections, on the basis of the print data while printing identification marks on the print sheets on the basis of identification mark data; and placing the print sheets, which have been printed and outputted at the respective printing sections, in a stack in a sheet discharge section.

Other and further objects and features of the present invention will become obvious upon an understanding of the illustrative embodiments about to be described in connection with the accompanying drawings or will be indicated in the appended claims, and various advantages not referred to herein will occur to one skilled in the art upon employing the present invention in practice.

BRIEF DESCRIPTION OF THE DRAWINGS

The invention, together with other features and advantages thereof, may best be understood by reference to the following description of the presently embodiments together with the accompanying drawings in which.

DETAILED DESCRIPTION OF THE EMBODIMENTS

Figure 1:
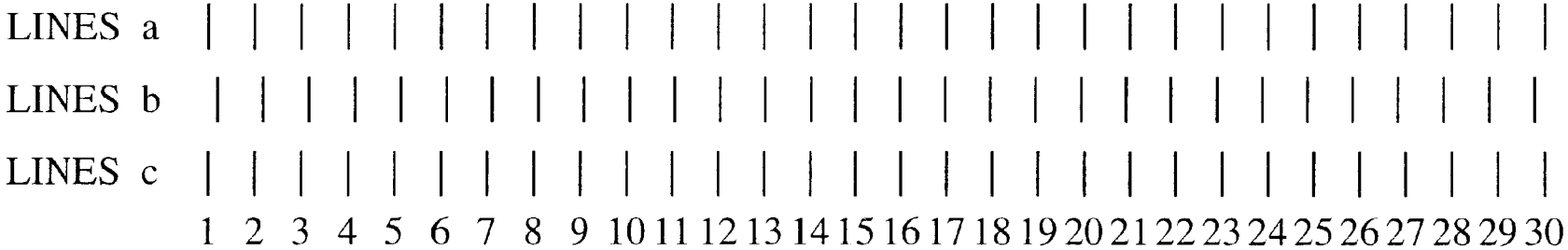
FIG. 1 is a view illustrating test patterns representing reproduced print cartridge adjustment data.

First and second embodiments and various example associated with the embodiments of the present invention will be described with reference to the accompanying drawings. It is to be noted that the same or similar reference numerals are assigned to the same or similar component parts and elements throughout the drawings, and the description of the same or similar component parts and elements will be omitted or simplified.

(First Embodiment)

Figure 2:
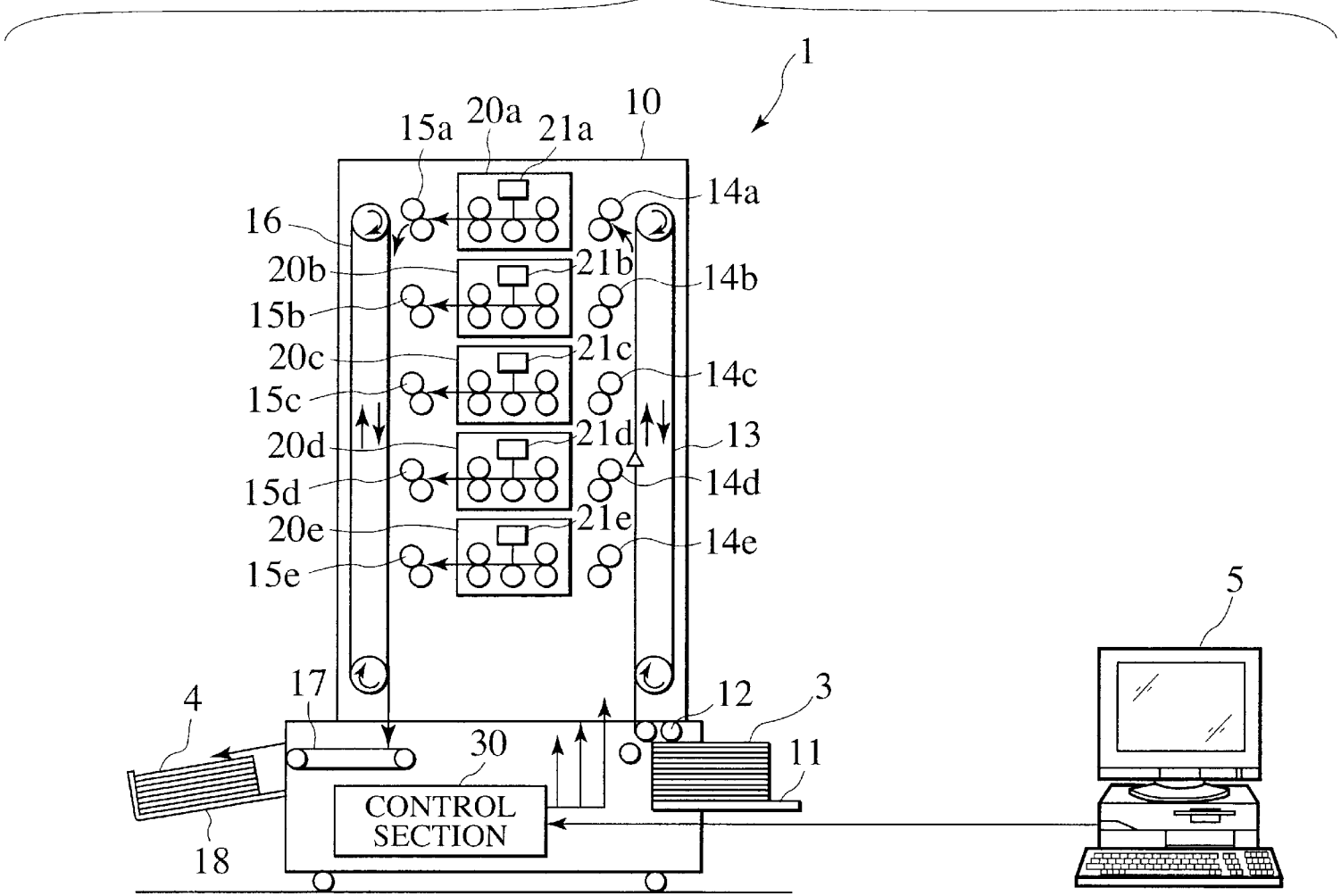
FIG. 2 is a typical overall view illustrating a structure of a first multi-layer printing machine according to a first embodiment of the present intention.

Referring to FIG. 2, an overall structure of the first multi-layer printing machine 1 of the first embodiment according to the present invention is described.

As shown in FIG. 2, the multi-layer printing machine 1 is comprised of a housing 10; a plurality of printing sections (or detachable printing units) 20*a*, 20*b*, 20*c*, 20*d*, 20*e* mounted in the housing 10 which are located array; a control section 30 mounted in the housing 10; and a paper feed tray 11 which receives a stack of print sheets 3.

Further, the multi-layer printing machine 1 has a paper feed section 12 which sequentially feeds the print sheets 3 to a paper transfer section 13 from the paper feed tray 11; the paper transfer section 13 which transfers the print sheets 3 to a plurality of printing sections 20*a*, 20*b*, 20*c*, 20*d*, 20*e*, respectively; a plurality of paper feed roller pairs 14*a*, 14*b*, 14*c*, 14*d*, 14*e* for introducing the print sheets 3 delivered from the paper transfer section 13 to respective printing sections 20*a*, 20*b*, 20*c*, 20*d*, 20*e*; the plurality of printing sections 20*a*, 20*b*, 20*c*, 20*d*, 20*e* fixedly mounted to the housing 10 of the multi-layer printing machine 1 for printing on the respective print sheets 3; a plurality of sheet discharge roller pairs 15*a*, 15*b*, 15*c*, 15*d*, 15*e* which transfer printed sheets 4 discharged from the printing sections 20*a*, 20*b*, 20*c*, 20*d*, 20*e*, to a discharge/transfer section 16; the discharge/transfer section 16 which transfers the printed sheets 4 discharged from the printing sections 15*a*, 15*b*, 15*c*, 15*d*, 15*e* to a sheet discharge section 17; the sheet discharge section 17 which receives the printed sheets 4 discharged from the discharge/transfer section 16 in a sheet discharge tray 18; and the sheet discharge tray 18 which receives the printed sheets 4 in a stacked state.

The printing sections 20*a*, 20*b*, 20*c*, 20*d*, 20*e* have a print heads 21*a*, 21*b*, 21*c*, 21*d*, 21*e* which implement printing on the print sheets 3 to reproduce desired print patterns in accordance with output commands delivered from the control section 30, respectively.

Further, the multi-layer printing machine 1 has a structure that is electrically connected to a computer 5 (an information processing equipment), which serves as an external input terminal, to allow given data to be inputted from the computer 5. Here, given data to be inputted involves print data such as character information and image information, etc. and, in addition thereto, identification mark data 6. Print data also involves print cartridge adjustment data 7 for outputting test patterns to be reproduced on the print sheets 3 when adjusting the alignments of the print heads or implementing cleaning operations of an ejection nozzles.

Furthermore, although the first multi-layer printing machine 1 of the first embodiment of the present invention is exemplified as having five printing sections 20*a*, 20*b*, 20*c*, 20*d*, 20*e* mounted in the housing 10, the printing machine 1 may have an increased number of or fewer of printing sections Now, normal printing operation of the first multi-layer printing machine 1 is described below.

In the first multi-layer printing machine 1, when given data is inputted from the computer 5 serving as the external input terminal and printing operation is started, the print sheets 3 are fed to the respective printing sections 20*a*, 20*b*, 20*c*, 20*d*, 20*e* via the paper feed section 12 and the paper transfer section 13. As the print sheets 3 are fed to the printing sections 20*a*, 20*b*, 20*c*, 20*d*, 20*e*, respectively, the control section 30 controls the print heads 21*a*, 21*b*, 21*c*, 21*d*, 21*e* so that a print image is reproduced on the print sheets 3 on the basis of print data. And, at the end of the printing operation, the printed sheets 4 are discharged from the respective printing sections 20*a*, 20*b*, 20*c*, 20*d*, 20*e*, with the discharged printed sheets 4 being discharged into the common sheet discharge tray 18 via the discharge/transfer section 16 and the sheet discharge section 17. The printed sheets 4, transferred from the discharge/transfer section 16, are sequentially stacked on the sheet discharge tray 18 with each printed surface facing upward.

According to the first multi-layer printing machine 1 explained above, since it is possible for the printing operation of the multiple number of print sheets to be executed at once in separate printing sections, the printing time of multiple printing operations is remarkably shortened.

Now, a description is given to a method of adjusting the alignment of print cartridges for the first multi-layer printing machines 1 of the first embodiment.

In the first multi-layer printing machines 1 of the first embodiment, there is a need to adjust the alignment of the print cartridges for plural printing sections 20*a*, 20*b*, 20*c*, 20*d*, 20*e*.

When adjusting the alignment of the print cartridges, a user transmits the control section 30 of the first multi-layer printing machines 1 with printer cartridge adjustment data 7 and identification mark data 6 via the computer 5.

Upon reception of print cartridge adjustment data 7 and identification mark data 6, the control section 30 controls the respective printing sections 20*a*, 20*b*, 20*c*, 20*d*, 20*e* to execute printing identification marks on the print sheets 3 and adjust the alignment of the print cartridge. In this case, the adjustment value stored in the control section 30 is disregarded.

Adjusting the alignment of the print cartridge is carried out in the respective printing sections 20*a*, 20*b*, 20*c*, 20*d*, 20*e* under the control of the control section 30.

First, a plurality of (for example, thirty marks) vertical rule marks, as indicated by a set of lines "a" in FIG. 1, are printed on a print sheet 3 at an equal interval by shifting each of the print heads 21*a*, 21*b*, 21*c*, 21*d*, 21*e* from left to right in the main scanning direction.

Then, a plurality of vertical rule marks, as indicated by a set of lines "b", are printed on the print sheet by shifting each of the print heads 21*a*, 21*b*, 21*c*, 21*d*, 21*e* from right to left in the main scanning direction, so that the amounts of displacement of the vertical rule marks "b" with respect to the previously printed vertical rule marks "a" gradually change (i. e. increase or decrease) at a predetermined rate.

Finally, the vertical rule marks, as indicated by a set of lines "c", are printed in the same manner as the vertical rule marks "a".

Further, the rest patterns printed which has had the identification mark representing the printed printing section and the alignment adjustment data for the print head printed is outputted from the printing sections 20*a*, 20*b*, 20*c*, 20*d*, 20*e*.

And, from among the test patterns, an operator selects the number of the test pattern which has a minimum value of shear in printing from the vertical rule marks in the sets of lines a, b, c, wherein the respective vertical rule marks in the sets of lines a, b, c are aligned in a straight line and it is determined that alignment between the printing from left to right in the main scanning direction and the printing from right to left in the main scanning direction has been achieved.

The adjustment value of the respective printing sections 20*a*, 20*b*, 20*c*, 20*d*, 20*e* wherein the respective vertical rule marks in the sets of lines a, b, c are aligned in a straight line is selected and is inputted to the control section 30 of the multi-layer printing machine 1 via a printer driver installed in the computer 5 connected to the multi-layer printing machine 1, and stored in particular section of the control section 30. When the multi-layer printing machine 1 performs printing, based on the adjustment value stored in the predetermined section of the control section 30 serve to control the ink ejection timing of the respective print heads 21*a*, 21*b*, 21*c*, 21*d*, 21*e*.

As described above, according to the first multi-layer printing machine 1 and the print cartridge adjusting methods of the first embodiment, since the identification mark for respective printing sections is printed on the printed sheets 4 to be printed with the respective printing sections 20*a*, 20*b*, 20*c*, 20*d*, 20*e*, it is possible to easily judge the corresponding relationship between the printing section and the associated printed sheet.

(Second Embodiment)

Figure 3:
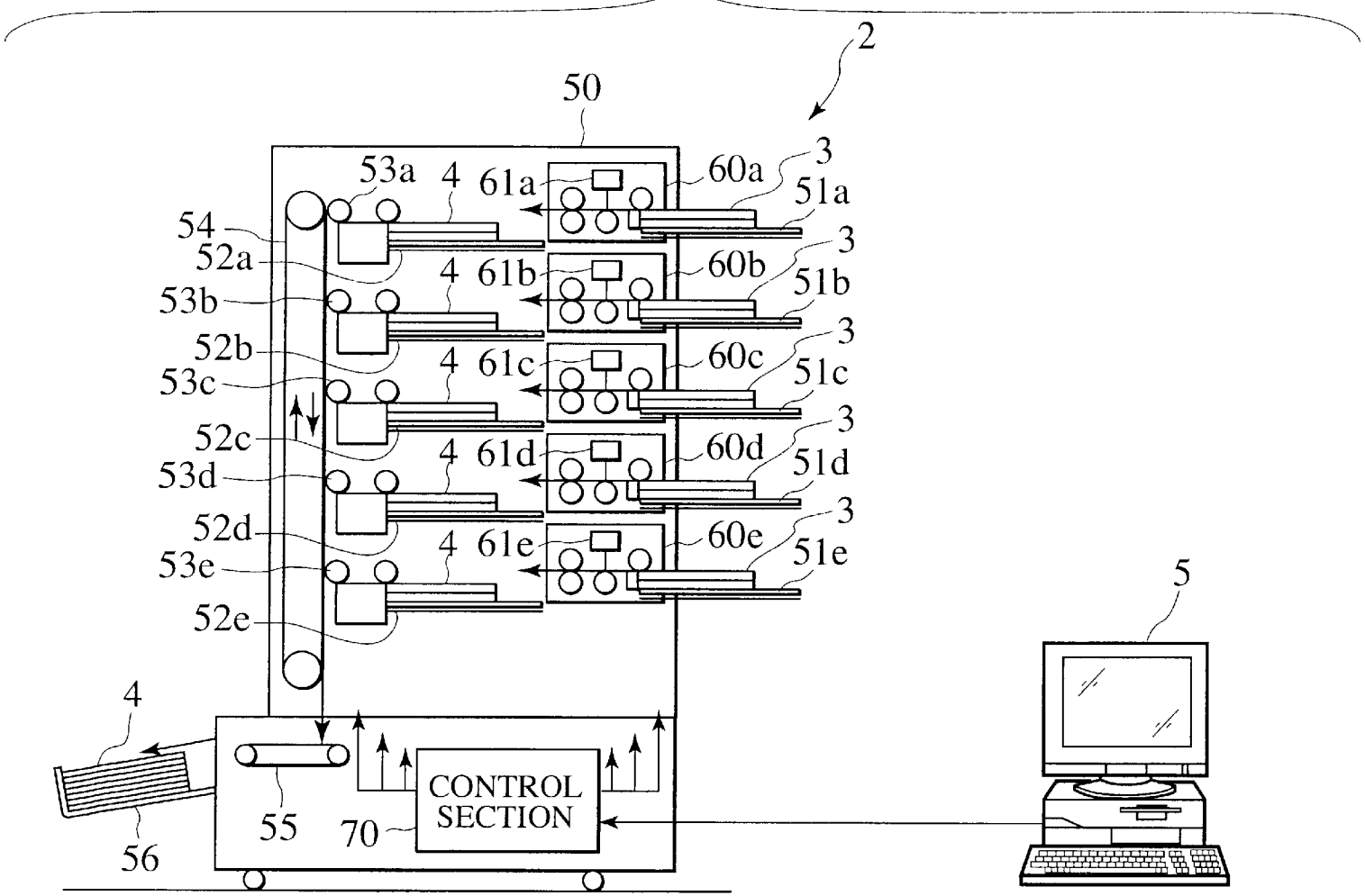
FIG. 3 is a typical overall view illustrating a structure of a second multi-layer printing machine according to a second embodiment of the present invention.

Referring now to FIG. 3, an overall structure of the second multi-layer printing machine 2 of the second embodiment according to the present invention is described.

As shown in FIG. 3, the multi-layer printing machine 2 includes a housing 50; the plurality of printing sections 60*a*, 60*b*, 60*c*, 60*d*, 60*e* mounted in the housing 50 for printing on the respective print sheets 3; paper feed sections 51*a*, 51*b*, 51*c*, 51*d*, 51*e* which sequentially feed print sheets 3 to printing sections 60*a*, 60*b*, 60*c*, 60*d*, 60*e*, respectively; a control section 70 mounted in the housing 50; stacker sections 52*a*, 52*b*, 52*c*, 52*d*, 52*e* which temporarily store the printed sheets 4, discharged from the printing sections 60*a*, 60*b*, 60*c*, 60*d*, 60*e*; sheet discharge rollers 53*a*, 53*b*, 53*c*, 53*d*, 53*e* which sequentially transfer printed sheets 4 stored in the stacker sections 52*a*, 52*b*, 52*c*, 52*d*, 52*e* to a sheet discharge and transfer section 54; the sheet discharge and transfer section 54 which transfer the printed sheets 4 transferred from the sheet discharge rollers 53 to a sheet discharge section 55; a sheet discharge section 55 which receives the printed sheets 4 transferred from the sheet discharge and transfer section 54 in the sheet discharge tray 56; and the sheet discharge tray 56 which receives the printed sheets 4.

The printing sections 60*a*, 60*b*, 60*c*, 60*d*, 60*e* have print heads 61*a*, 61*b*, 61*c*, 61*d*, 61*e* which implement printing on the print sheets 3 to reproduce desired print patterns thereon in accordance with output signals delivered from the control section 70, respectively.

Further, although the multi-layer printing machine 2 of the second embodiment of the present invention is exemplified as having five printing sections 60*a*, 60*b*, 60*c*, 60*d*, 60*e* mounted in the housing 50, the printing machine 2 may have a further increased number of or fewer printing sections Now, normal printing operation of the second multi-layer printing machine 2 is described below.

In the second multi-layer printing machine 2, when given data is input from the computer 5 serving as the external input terminal and printing operation is started, a print image is reproduced on the print sheets 3 fed from the respective paper feed sections 51*a*, 51*b*, 51*c*, 51*d*, 51*e* on the basis of print data, using the same process as attained in the first multi-layer printing machine 1 shown in FIG. 2 whereupon, the printed sheets 4 are temporarily stored in the stacker sections 52*a*, 52*b*, 52*c*, 52*d*, 52*e*. Thereafter, the printed sheets 4 are discharged to the single sheet discharge tray 56 via the sheet discharge and transfer section 54 and the sheet discharge section 55. Thus, the printed sheets 4 are sequentially stacked on the sheet discharge tray 56 with each printed surface facing upward.

According to the second multi-layer printing machine 2 explained above, since it is possible for the printing operation of the multiple number of print sheets to be executed at once in separate printing sections, the printing time of multiple printing operations is remarkably shortened.

Now, a method of adjusting the alignment of print cartridges for the second multi-layer printing machines 2 according to the second embodiment is described below.

In the second multi-layer printing machines 2 of the first embodiment, there is a need to adjust the alignment of the print cartridges for plural printing sections 60*a*, 60*b*, 60*c*, 60*d*, 60*e*.

When adjusting the alignment of the print cartridges, a user transmits the control section 70 of the second multi-layer printing machines 2 with printer cartridge adjustment data 7 and identification mark data 6 via the computer 5.

Upon reception of print cartridge adjustment data 7 and identification mark data 6, the control section 70 controls the respective printing sections 60*a*, 60*b*, 60*c*, 60*d*, 60*e* to execute printing identification marks on the print sheets 3 and adjust the alignment of the print cartridge. In this case, the adjustment value stored in the control section 70 is disregarded.

Adjusting the alignment of the print cartridge is carried out in the respective printing sections 60*a*, 60*b*, 60*c*, 60*d*, 60*e* under the control of the control section 70.

First, a plurality of (for example, thirty) vertical rule marks, as indicated by a set of lines "a" in FIG. 1, are printed on a print sheet 3 at an equal interval by shifting each of the print heads 61*a*, 61*b*, 61*c*, 61*d*, 61*e* from left to right in the main scanning direction.

Then, a plurality of vertical rule marks, as indicated by a set of lines "b", are printed on the print sheet by shifting each of the print heads 61*a*, 61*b*, 61*c*, 61*d*, 61*e* from right to left in the main scanning direction, so that the amounts of displacement of the vertical rule marks "b" with respect to the previously printed vertical rule marks lines "a" gradually change (i.e. increase or decrease) at a predetermined rate.

Finally, the vertical rule marks, as indicated by a set of lines "c", are printed in the same manner as the vertical rule marks "a".

Further, the test patterns printed which has had the identification mark representing the printed printing section and the alignment adjustment data for the print head printed is outputted from the printing sections 60*a*, 60*b*, 60*c*, 60*d*, 60*e*.

And, from among the test patterns, an operator selects the number of the test pattern which has a minimum value of shear in printing from the vertical rule marks in the sets of lines a, b, c, wherein the respective vertical rule marks in the sets of lines a, b, c are aligned in a straight line and it is determined that alignment between the printing from left to right in the main scanning direction and the printing from right to left in the main scanning direction has been achieved.

The adjustment value of the respective printing sections 60*a*, 60*b*, 60*c*, 60*d*, 60*e* wherein the respective vertical rule marks in the sets of lines a, b, c are aligned in a straight line is selected and is inputted to the control section 70 of the multi-layer printing machine 2 via a printer driver installed in the computer 5 connected to the multi-layer printing machine 2, and stored in particular section of the control section 70. When the multi-layer printing machine 2 performs printing, based on the adjustment value stored in the predetermined section the control section 70 serve to control the ink ejection timing of the respective print heads 61*a*, 61*b*, 61*c*, 61*d*, 61*e*.

As described above, according to the second multi-layer printing machine 2 and the print cartridge adjusting method of the second embodiment, since the identification mark for respective printing sections is printed on the print sheets 4 to be printed by the respective printing sections 60*a*, 60*b*, 60*c*, 60*d*, 60*e*, it is possible to easily judge the corresponding relationship between the printing section and the associated printed sheet.

FIRST EXAMPLE

Figure 4:
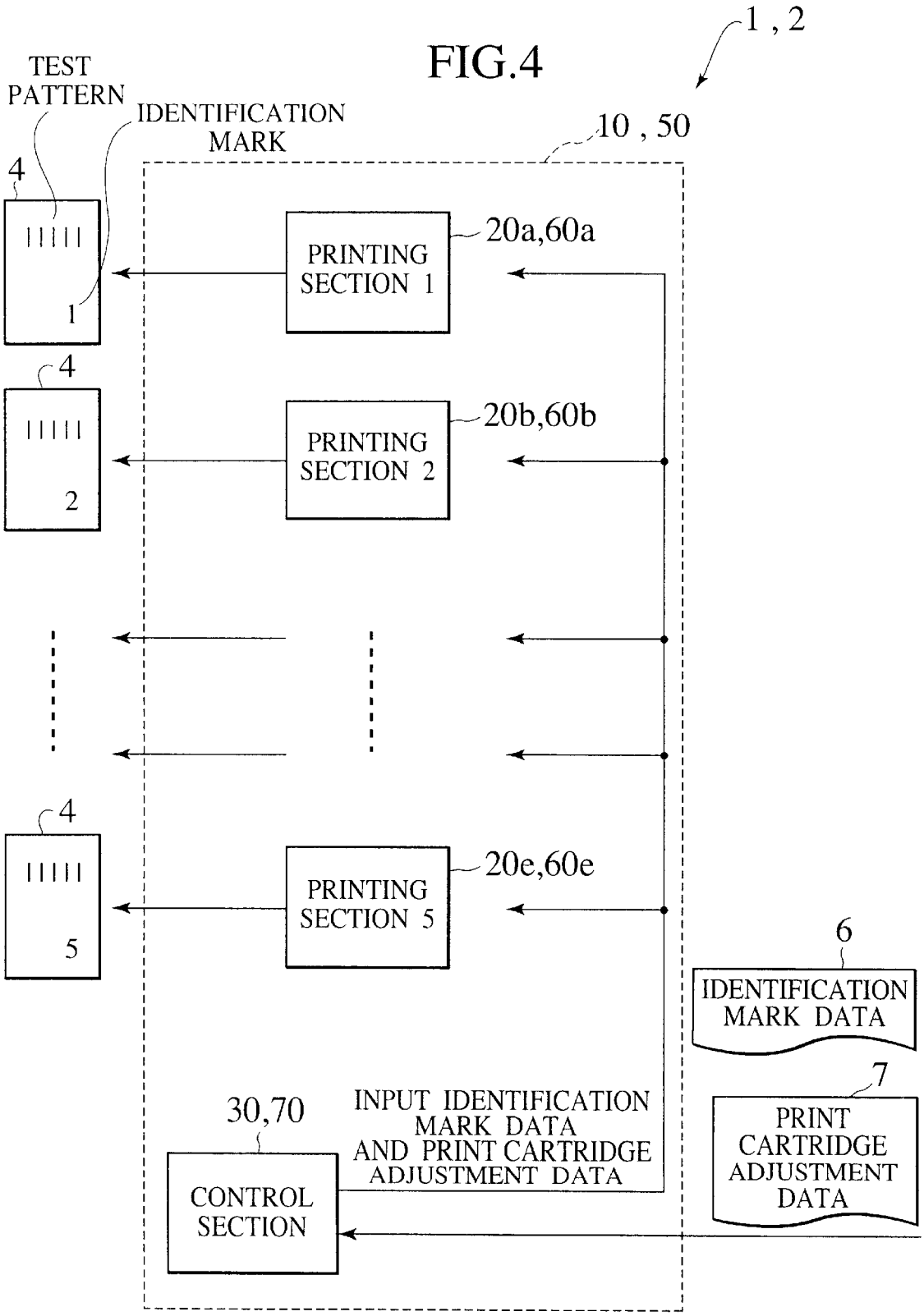
FIG. 4 is a typical view illustrating the basic principle of operation of a control section according to a first example of the first and second embodiments.

Referring now to FIG. 4, a description is made for a method of adjusting a print cartridge for the multi-layer printing machine according to a first example of the first and second embodiments.

The multi-layer printing machine 1 according to the first embodiment is comprised of a housing 10; a plurality of printing sections (or detachable printing units) 20*a*, 20*b*, 20*c*, 20*d*, 20*e* mounted in the housing 10; and a control section 30 mounted to the housing 10. Further, the multi-layer printing machine 1 has a structure that is electrically connected to a computer 5 (not shown), which serves as an external input terminal.

The multi-layer printing machine 2 according to the second embodiment is comprised of a housing 50; a plurality of printing sections (or detachable printing units) 60*a*, 60*b*, 60*c*, 60*d*, 60*e* mounted in the housing 50; and a control section 70 mounted in the housing 50. Further, the multi-layer printing machine 2 has a structure that is electrically connected to a computer 5 (not shown), which serves as an external input terminal.

Here, while the description is made with reference to the method of adjusting the print cartridge for the multi-layer printing machine 1 of the first embodiment, the adjustment of the print cartridge of multi-layer printing machine 2 of the second embodiment can also be performed with the same method as that of printing machine 1, therefore, its explanation is omitted. (In explanation of the first embodiment, the control section 30 is read as the control section 70, the printing sections 20*a*, 20*b*, 20*c*, 20*d*, 20*e* is read as the printing sections 60*a*, 60*b*, 60*c*, 60*d*, 60*e*, and the housing 10 is read as the housing 50.)

First, the control section 30 is applied with common printer cartridge adjustment data 7 for the respective printing sections and identification mark data 6 which corresponds to the respective printing sections 20*a*, 20*b*, 20*c*, 20*d*, 20*e* via the printer driver, etc., of the computer 5 (not shown) connected to the multi-layer printing machine 1.

Upon reception of the common print cartridge adjustment data 7 and the identification mark data 6, the control section 30 transmit the common print cartridge adjustment data 7 and discrete identification mark data 6 to the respective printing sections 20*a*, 20*b*, 20*c*, 20*d*, 20*e*.

In response to print cartridge adjustment data 7 and identification mark data 6 peculiar to the respective printing sections, the respective printing sections 20*a*, 20*b*, 20*c*, 20*d*, 20*e* print the test patterns on the print sheets 3 (not shown) which have been transferred from the paper feed section 11 (not shown) via the paper transfer section 13 (not shown).

And, the printed sheets 4, which are printed with the common test patterns and the identification marks peculiar to the respective printing sections, are discharged from the respecting printing sections 20*a*, 20*b*, 20*c*, 20*d*, 20*e* and transferred to the sheet discharge tray 18 (not shown) to be stacked thereon via the discharge/transfer section 16 (not shown).

According to the method of adjustment of print cartridge related to the first example, the test pattern is able to be printed with the identification mark representing which particular printing section has carried out the printing operation. Even if the printed sheets 4 discharged from the plural printing sections are stored in the single sheet discharge tray, reference to the identification marks printed to the printed sheets 4 makes it possible to easily judge which printing section has printed the test pattern, enabling the print cartridge to be efficiently adjusted.

SECOND EXAMPLE

Figure 5:
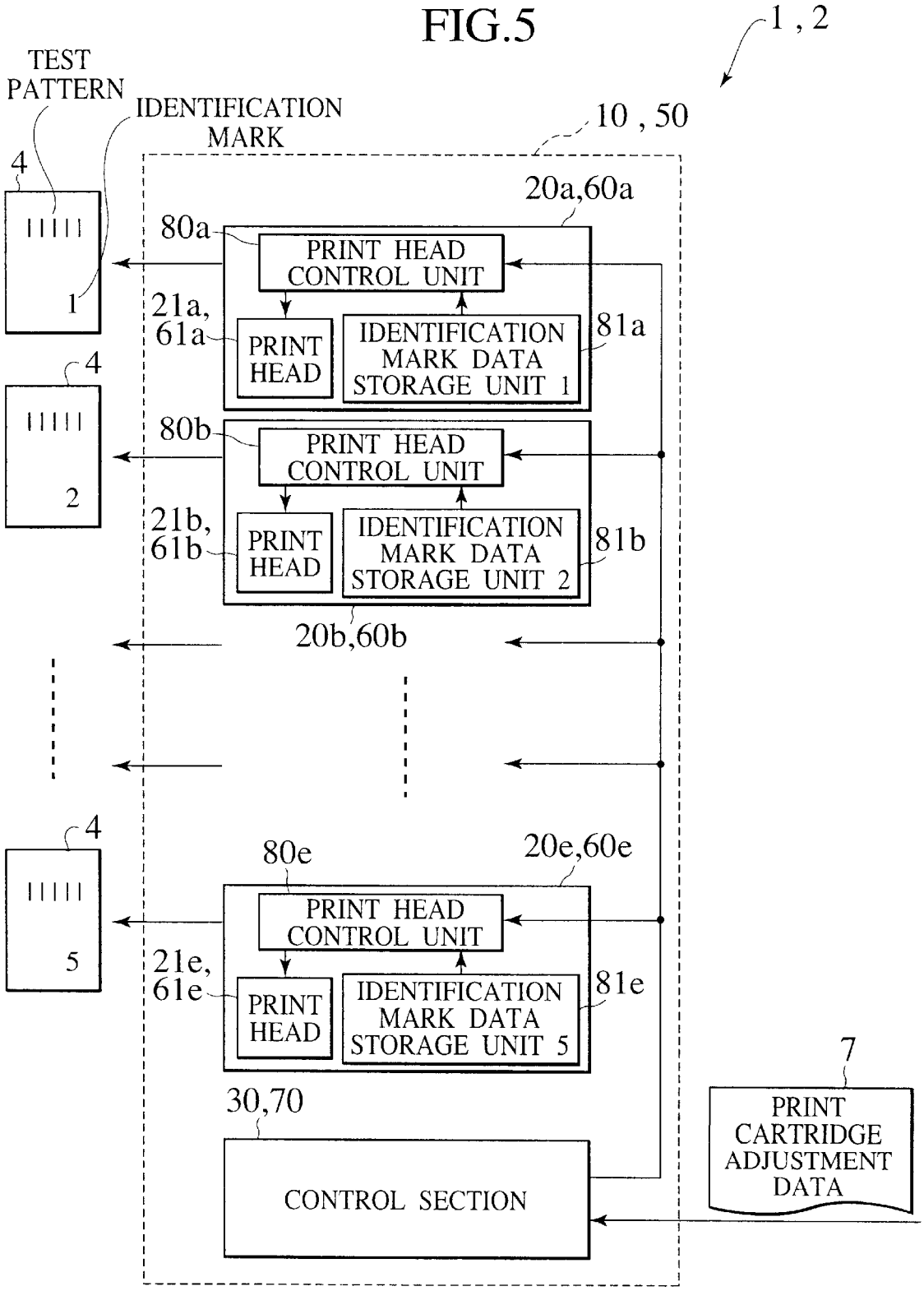
FIG. 5 is a typical view illustrating the basic principle of operation of a control section according to a second example of the first and second embodiments.

Referring now to FIG. 5, a method of adjustment of print cartridges in the multi-layer printing machine according to a second example of the first and second embodiments is described below.

The multi-layer printing machine of the second example according to the first and second embodiments employs the same step of applying the identification marks on the print sheets as in that of the first example but differs from the first example in that the identification mark data 6 is not input from the computer 5 external the printer but is stored in identification mark data storage sections of the respective printing sections.

As shown FIG. 5, the multi-layer printing machine 1 of the second example is comprised of a housing 10; a plurality of printing sections (or detachable printing units) 20*a*, 20*b*, 20*c*, 20*d*, 20*e* mounted in the housing 10; and a control section 30 mounted in the housing 10. Further, the multi-layer printing machine 1 has a structure that is electrically connected to a computer 5 (not shown), which serves as an external input terminal The respective printing sections 20*a*, 20*b*, 20*c*, 20*d*, 20*e* include print heads 21*a*, 21*b*, 21*c*, 21*d*, 21*e*; print head control units 80*a*, 80*b*, 80*c*, 80*d*, 80*e*; and identification mark data storage units 81*a*, 81*b*, 81*c*, 81*d*, 81*e* which store identification mark data 6 for identifying respective printing sections.

The multi-layer printing machine 2 of the second example is comprised of a housing 50; a plurality of printing sections (or detachable printing units) 60*a*, 60*b*, 60*c*, 60*d*, 60*e* mounted in the housing 50; and a control section 70 mounted in the housing 50. Further, the multi-layer printing machine 2 has a structure that is electrically connected to a computer 5 (not shown), which serves as an external input terminal.

The respective printing sections 60*a*, 60*b*, 60*c*, 60*d*, 60*e* include print heads 61*a*, 61*b*, 61*c*, 61*d*, 61*e*; print head control units 80*a*, 80*b*, 80*c*, 80*d*, 80*e*; and identification mark data storage units 81*a*, 81*b*, 81*c*, 81*d*, 81*e* which store identification mark data 6 for identifying respective printing sections.

While the method of adjusting the print cartridge for the first multi-layer printing machine 1 of the second example is described below, the method of adjusting the print cartridge for the second multi-layer printing machine 2 of the second example is identical to that of the first multi-layer printing machine 1, therefore, its explanation is omitted. (In explanation of the first embodiment, the control section 30 is read as the control section 70, the printing sections 20*a*, 20*b*, 20*c*, 20*d*, 20*e* is read as the printing sections 60*a*, 60*b*, 60*c*, 60*d*, 60*e*, the printing heads 21*a*, 21*b*, 21*c*, 21*d*, 21*e* is read as the print heads 61*a*, 61*b*, 61*c*, 61*d*, 61*e*, and the housing 10 is read as the housing 50.)

First, the control section 30 is applied with common print cartridge adjustment data 7 for the respective printing sections 20*a*, 20*b*, 20*c*, 20*d*, 20*e* via the printer driver, etc. of the computer 5 (not shown) connected to the multi-layer printing machine 1.

Upon reception of the common print cartridge adjustment data 7, the control section 30 transmits the common print cartridge adjustment data 7 to the print head control units 80*a*, 80*b*, 80*c*, 80*d*, 80*e*.

The respective print head control units 80*a*, 80*b*, 80*c*, 80*d*, 80*e* serve to print the test patterns on the print sheets 3 (not shown) which have been transferred from the paper feed section 11 (not shown) via the paper transfer section 13 (not shown) with reference to identification mark data 6 stored in the identification mark data storage units 81*a*, 81*b*, 81*c*, 81*d*, 81*e*, while the respective print heads 21*a*, 21*b*, 21*c*, 21*d*, 21*e* print the test patterns on the print sheets 3 (not shown).

And, the printed sheets 4, which are printed with the test patterns and the identification marks peculiar to the respective printing sections, are discharged from the respecting printing sections 20*a*, 20*b*, 20*c*, 20*d*, 20*e* and transferred to the sheet discharge tray 18 (not shown) to be stacked thereon via the discharge/transfer section 16 (not shown).

According to the method of adjustment of print cartridge related to the second example, the test pattern is able to be printed with the identification mark representing which particular printing section has carried out the printing operation. Even if the printed sheets 4 discharged from the plural printing sections are stored in the single sheet discharge tray reference to the identification marks printed to the printed sheets 4 makes it possible to easily judge which printing section has printed the test pattern, enabling the print cartridge to be efficiently adjusted.

THIRD EXAMPLE

Figure 6:
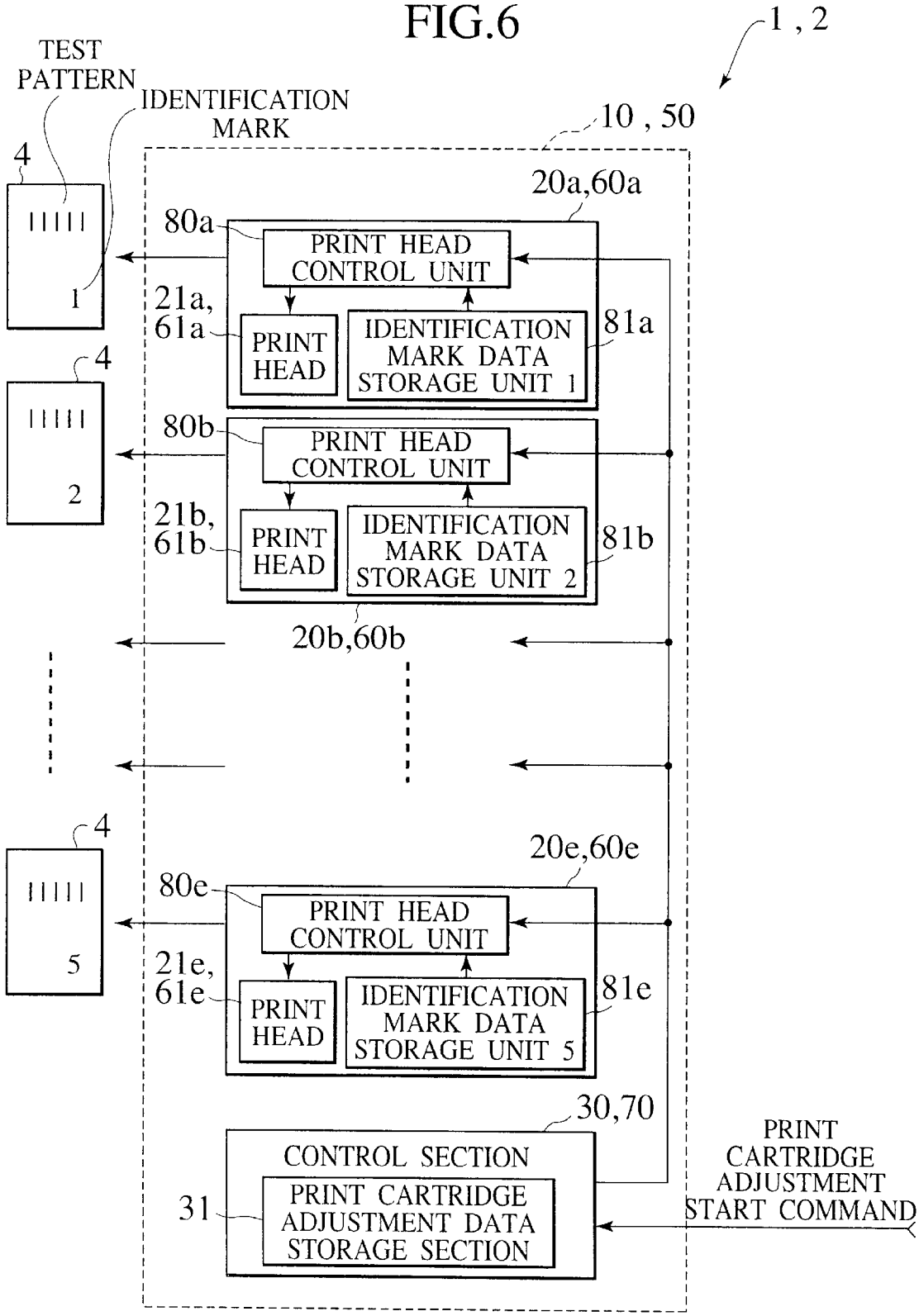
FIG. 6 is a typical view illustrating the basic principle of operation of a control section according to a third example of the first and second embodiments.

Referring now to FIG. 6, a method of adjusting a print cartridge for the multi-layer printing machine of a third example of the first and second embodiments is described below.

The multi-layer printing machine of the third example according to the present invention employs the same step of printing identification marks. However the third example differs from these examples in that the print cartridge adjustment data 7 and the identification mark data 6 are not input from the computer 5 (not shown) connected to the multi-layer printing machine but the print cartridge adjustment data 7 is stored in a print cartridge adjustment data storage section 31, and the identification mark data 6 is stored in an identification mark data storage units 81*a*, 81*b*, 81*c*, 81*d*, 81*e*.

The first multi-layer printing machine 1 of the third example is comprised of a housing 10; a plurality of printing sections (or detachable printing units) 20*a*, 20*b*, 20*c*, 20*d*, 20*e* mounted in the housing 10; and a control section 30 mounted in the housing 10. The respective printing sections 20*a*, 20*b*, 20*c*, 20*d*, 20*e* include print heads 21*a*, 21*b*, 21*c*, 21*d*, 21*e*; print head control units 80*a*, 80*b*, 80*c*, 80*d*, 80*e*; and identification mark data storage units 81*a*, 81*b*, 81*c*, 81*d*, 81*e* which store identification mark data 6 for identifying respective printing sections, with the control section 30 including a print cartridge adjustment data storage section 31 which stores print cartridge adjustment data 7.

The second multi-layer printing machine 2 of the third example is comprised of a housing 50; a plurality of printing sections (or detachable printing units) 60*a*, 60*b*, 60*c*, 60*d*, 60*e* mounted in the housing 50; and a control section 70 mounted in the housing 50. The respective printing sections 60*a*, 60*b*, 60*c*, 60*d*, 60*e* include print heads 61*a*, 61*b*, 61*c*, 61*d*, 61*e*; print head control units 80*a*, 80*b*, 80*c*, 80*d*, 80*e*; and identification mark data storage units 81*a*, 81*b*, 81*c*, 81*d*, 81*e* which store identification mark data 6 for identifying respective printing sections, with the control section 70 including a print cartridge adjustment data storage section 31 which stores print cartridge adjustment data 7.

While the method of adjustment of the print cartridge for the first multi-layer printing machine 1 of the third example is described below, the method of adjustment of the print cartridge for the second multi-layer printing machine 2 of the third example is identical to that of the first multi-layer printing machine 1, therefore, its explanation is omitted. (The method of printing identification marks and adjustment of the print cartridge for the second multi-layer printing machine 2 of the third example is identical to that of the first multi-layer printing machine 1, in explanation of the printing method of first multi-layer printing machine 1 of the third example, the discharge/transfer section 16 and the sheet discharge tray 18 are read as the sheet discharge and transfer section 54 and the sheet discharge tray 56, respectively, the paper feed section 11 and the paper transfer section 13 are read as the paper feed sections 51*a*, 51*b*, 51*c*, 51*d*, 51*e*, the printing sections 20*a*, 20*b*, 20*c*, 20*d*, 20*e* is read as the printing sections 60*a*, 60*b*, 60*c*, 60*d*, 60*e*.)

First, the control section 30 is applied with print cartridge adjustment start command for the respective printing sections via the operation panel 90 (not shown) mounted on the housing 10 of the first multi-layer printing machine 1 or the printer driver, etc. of the computer 5 (not shown) connected to the multi-layer printing machine 1.

Upon reception of the print cartridge adjustment start command, the control section 30 transmits the print cartridge adjustment data 7 and the print cartridge adjustment start signal to the print head control units 80*a*, 80*b*, 80*c*, 80*d*, 80*e* by referring to the print cartridge adjustment data 7 of the print cartridge adjustment data storage section 31.

Subsequently, the respective print head control units 80*a*, 80*b*, 80*c*, 80*d*, 80*e* control the respective print heads 21*a*, 21*b*, 21*c*, 21*d*, 21*e* to allow test patterns to be printed on the print sheets 3 (not shown) transferred from the paper feed section 11 (not shown) on the basis of print cartridge adjustment data 7, and to allow identification marks to be printed on the print sheets 3 (not shown) with reference to the identification mark data 6 stored in the identification mark data storage units 81*a*, 81*b*, 81*c*, 81*d*, 81*e*.

And, the printed sheets 4 printed with the test patterns and the identification marks peculiar to the respective printing sections are discharged from the respective printing sections 20*a*, 20*b*, 20*c*, 20*d*, 20*e* and are stacked on the common sheet discharge tray 18 (not shown) via the discharge/transfer section 16 (not shown).

According to the method of adjustment of print cartridge related to the third example, the test pattern is able to be printed with the identification mark representing which particular printing section has carried out the printing operation. Even if the printed sheets 4 discharged from the plural printing sections are stored in the single sheet discharge tray, reference to the identification marks printed to the printed sheets 4 makes it possible to easily judge which printing section has printed the test pattern, enabling the print cartridge to be efficiently adjusted.

FOURTH EXAMPLE

When executing a printing operation using a printing machine with plural printing sections, there are some instances where the quality of a printed sheet is deteriorated due only to blurred ink or other such reasons, with resultant unevenness caused in the print quality of the printed sheets stacked on the sheet discharge tray.

In such instances, the following process maybe implemented in order to easily ascertain which printed sheet, printed by which particular printing section, has encountered deterioration in print quality.

Figure 7:
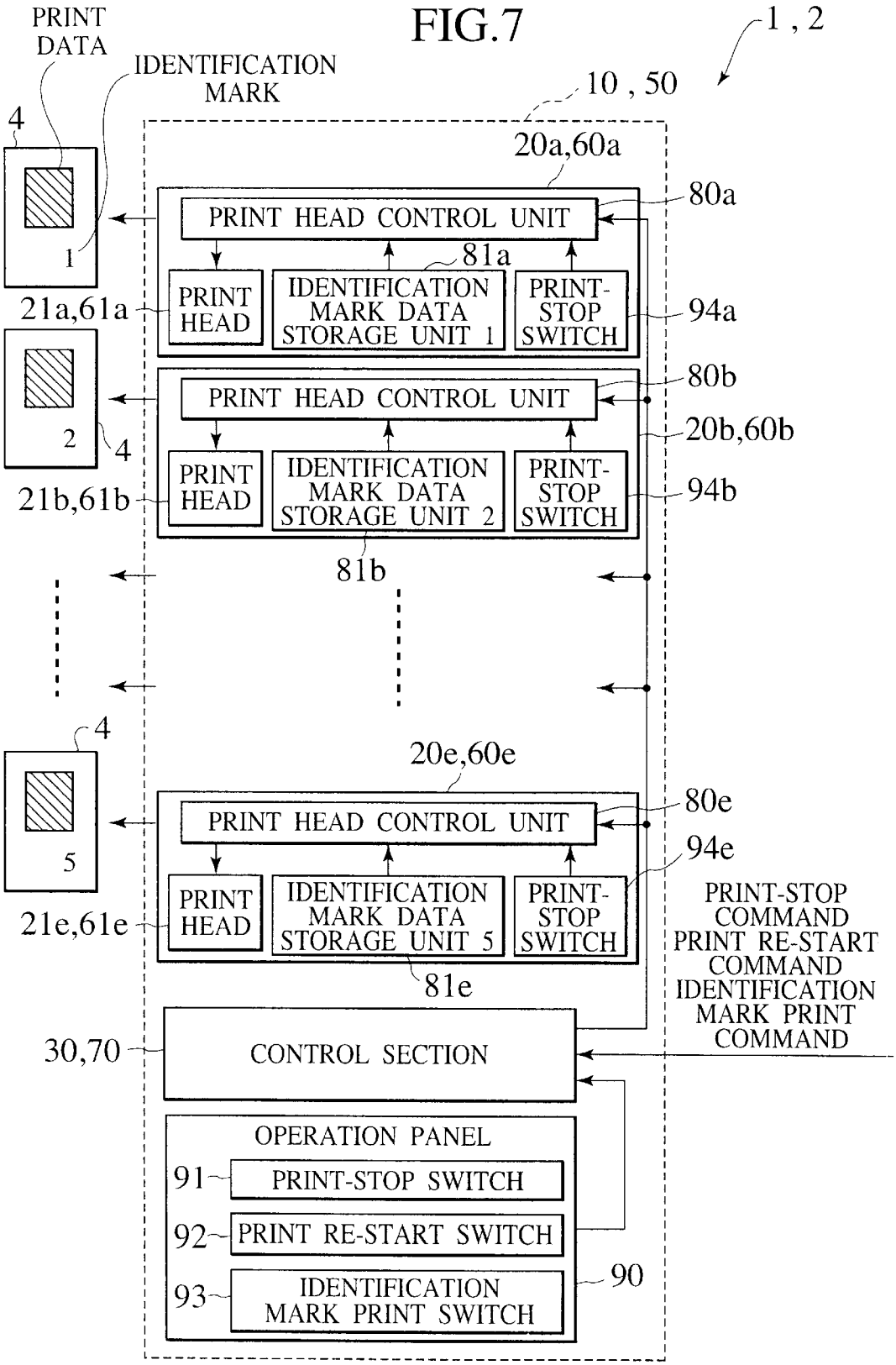
FIG. 7 is a typical view illustrating the basic principle of operation of a control section according to a fourth example of the first and second embodiments.

In FIG. 7, the first multi-layer printing machine 1 of the fourth example is comprised of a housing 10; a plurality of printing sections (or detachable printing units) 20*a*, 20*b*, 20*c*, 20*d*, 20*e* mounted in the housings 10; a control section 30 mounted in the housing 10; and operation panel 90 for enabling input operation, as in the configurations shown in FIG. 2.

And, the respective printing sections 20*a*, 20*b*, 20*c*, 20*d*, 20*e* include print heads 21*a*, 21*b*, 21*c*, 21*d*, 21*e*; print head control units 80*a*, 80*b*, 80*c*, 80*d*, 80*e*; identification mark data storage units 81*a*, 81*b*, 81*c*, 81*d*, 81*e*; and print-stop switches 94*a*, 94*b*, 94*c*, 94*d*, 94*e* for stopping printing operation.

The operation panel 90 has a print-stop switch 91 for interrupting the printing operation, a print re-start switch 92 for enabling the re-starting of a printing operation, and an identification mark print switch 93 for applying identification marks onto the print sheets 3 (not shown).

The second multi-layer printing machine 2 of the fourth example is comprised of a housing 50; a plurality of printing sections (or detachable printing units) 60*a*, 60*b*, 60*c*, 60*d*, 60*e* mounted to the housings 50; a control section 70 mounted to the housing 50; and operation panel 90 for enabling input operation, as in the configurations shown in FIG. 3.

And, the respective printing sections 60*a*, 60*b*, 60*c*, 60*d*, 60*e* include print heads 61*a*, 61*b*, 61*c*, 61*d*, 61*e*; print head control units 80*a*, 80*b*, 80*c*, 80*d*, 80*e*; identification mark data storage units 81*a*, 81*b*, 81*c*, 81*d*, 81*e*; and print-stop switches 94*a*, 94*b*, 94*c*, 94*d*, 94*e* for stopping printing operation.

The operation panel 90 has a print-stop switch 91 for interrupting the printing operation, a print re-start switch 92 for enabling the re-starting of a printing operation, and an identification mark print switch 93 for applying the identification marks onto the paint sheets 3 (not shown).

Further, the identification mark data 6 is stored in the identification mark data storage sections 81*a*, 81*b*, 81*c*, 81*d*, and 81*e* of the respective printing sections.

Referring now to FIG. 7, a printing method of the fourth example according to the present invention is described below. Here, while description is made with reference to the printing method for the first multi-layer printing machine 1 of the first embodiment, it is to be noted that the printing method of the second printing machine 2 of the second embodiment is identical to that of the first multi-layer printing machine 1, therefore, its explanation is omitted. (The printing method of the second printing machine 2 of the second embodiment is identical to that of the first multi-layer printing machine 1, in explanation of the printing method of first multi-layer printing machine 1 of the fourth example, the discharge/transfer section 16 and the sheet discharge tray 18 are read as the sheet discharge and transfer section 54 and the sheet discharge tray 56, respectively, the paper feed section 11 and the paper transfer section 13 are read as the paper feed sections 51*a*, 51*b*, 51*c*, 51*d*, 51*e*, the printing sections 20*a*, 20*b*, 20*c*, 20*d*, 20*e* is read as the printing sections 60*a*, 60*b*, 60*c*, 60*d*, 60*e*).

Initially, when the print-stop switch 91 is operated during a printing operation in response to print data, a print-stop command is transmitted to the control section 30, which responds to the print-stop command and controls the respective printing sections 20*a*, 20*b*, 20*c*, 20*d*, 20*e* to interrupt operations thereof.

Consecutively, when the identification mark print switch 93 is operated, an identification mark print command is transmitted to the control section 30, which controls the respective print head control units 80*a*, 80*b*, 80*c*, 80*d*, 80*e* in response to the identification mark print command.

The respective print head control units 80*a*, 80*b*, 80*c*, 80*d*, 80*e* control the print heads 21*a*, 21*b*, 21*c*, 21*d*, 21*e* to allow the identification marks to be printed on the print sheets 3 (not shown) with reference to identification mark data 6 stored in the identification mark data storage units 81*a*, 81*b*, 81*c*, 81*d*, 81*e*.

And, the printed sheets 4, which are printed with the print data and identification marks peculiar to the respective printing sections, are discharged from the respecting printing sections 20*a*, 20*b*, 20*c*, 20*d*, 20*e* and transferred to the sheet discharge tray 18 (not shown) to be stacked thereon via the discharge/transfer section 16 (not shown).

Here, an operator checks the identification mark printed on the printed sheets 4 to confirm the printing section that outputted the printed sheet 4, thereby allowing a selected one of the print-stop switches 94*a*, 94*b*, 94*c*, 94*d*, 94*e* to be operated, thereby interrupting the operation of the particular printing section, which outputted the printed sheet 4 of deteriorated quality.

Subsequently, when the print re-start switch 92 is operated, a print re-start command is transmitted to the control section 30, which responds to the print re-start command to re-start the printing sections excluding the particular printing section which has been interrupted.

In the examples described above, also, while the print-stop command, the print re-start command and the identification mark print command have been discussed as being applied to the control section 30 via the operation panel 90, these commands may be inputted from the computer 5 (not shown) connected to the multi-layer printing machine 1.

According to the multi-layer printing machines and the method of the fourth example, in a case where a printed sheet printed at a deteriorated print quality happens to be discharged to the sheet discharge tray during printing operation with the use of the plural printing sections, since the operator is able to print the identification mark, it is easy for the operator to judge the particular printing section which has caused the deterioration in print quality of the particular printed sheet.

(Other Embodiment)

Various modifications will become possible for those skilled in the art after receiving the teaching of the present disclosure without departing from the scope thereof. Thus, the present invention of course includes various embodiments and modifications and the like which are not detailed above. Therefore, the scope of the present invention will be defined in the following claims.

What is claimed is:

1. A printing machine comprising:

a housing;

a plurality of printing sections mounted in the housing configured to execute printing operation on the basis of given data;

a control section mounted in said housing configured to control the respective printing sections to print on print sheets on the basis of print data and to print identification marks on the print sheets on the basis of identification mark data representing which printing section executes the printing operation; and a sheet discharge section configured to allow printed sheets ejected from each of the plurality of printing sections.

2. The printing machine according to claim 1, wherein the print data and the identification mark data are inputted to the printing machine via an external input terminal.

3. The printing machine according to claim 2, wherein the external input terminal comprises a computer through which the print data and the identification mark data are inputted to the printing machine.

4. The printing machine according to claim 1, wherein the printing machine includes a storage section which stores the identification mark data.

5. The printing machine according to claim 4, wherein the storage section includes storage units located for the respective printing sections configured to store discrete identification mark data correlating to the respective printing sections.

6. The printing machine according to claim 1, wherein the print data includes print cartridge adjustment data for allowing a print cartridge to be adjusted.

7. A method of printing, comprising the steps of:

printing on print sheets by a plurality of printing sections on the basis of print data;

printing identification marks on the print sheets on the basis of identification mark data representing which printing section is operated to execute printing; and placing the print sheets, which are printed and outputted at the respective printing sections, in a stack in a sheet discharge section.

8. The method of printing according to claim 7, wherein the print data involves a print cartridge adjustment data for adjusting a print cartridge.

9. A method of printing, comprising the steps of:

inputting print data and identification mark data into a printing machine having a plurality of printing sections, said identification mark data representing which printing section is operated to execute printing;

allocating the print data and the identification mark data to corresponding printing sections, respectively;

printing on print sheets, transferred to said plurality of printing sections, on the basis of the print data while printing identification marks on the print sheets on the basis of identification mark data; and placing the print sheets, which are printed and outputted at the respective printing sections, in a sheet discharge section in a stack.

10. The method of printing according to claim 9, wherein the print data involves a print cartridge adjustment data for adjusting a print cartridge.

* * * * *